United States Patent [19]

Eik

[11] 4,147,330

[45] Apr. 3, 1979

[54] METHOD FOR SETTING DOWN OR TAKING UP A LOAD FROM OR UPON A LOADING LOCATION BY MEANS OF A CRANE AND AN APPARATUS FOR CARRYING OUT THE METHOD

[75] Inventor: Geir Eik, Ski, Norway

[73] Assignee: A/S NorMar, Oslo, Norway

[21] Appl. No.: 825,102

[22] Filed: Aug. 16, 1977

[30] Foreign Application Priority Data

Aug. 20, 1976 [NO] Norway ..... 762888

[51] Int. Cl.[2] ..... B66D 1/48

[52] U.S. Cl. ..... 254/173 R; 254/178; 414/137

[58] Field of Search ..... 254/173 R, 172, 178, 254/186 R; 214/12, 13, 14; 212/3; 60/907; 175/27, 5; 267/113

[56] References Cited

U.S. PATENT DOCUMENTS

| | | | |
|---|---|---|---|
| 2,814,032 | 11/1957 | Agnew et al. | 214/12 |
| 3,189,196 | 6/1965 | Carl et al. | 214/14 |
| 3,309,065 | 3/1967 | Prudhomme et al. | 214/14 |
| 3,388,070 | 6/1968 | Born et al. | 254/172 |
| 3,480,255 | 11/1969 | Wiggins | 254/178 |
| 3,591,022 | 7/1971 | Gagarina et al. | 214/13 |
| 3,753,552 | 8/1973 | Barron | 214/14 |
| 3,917,230 | 11/1975 | Barron | 254/173 R |

*Primary Examiner*—Douglas C. Butler
*Assistant Examiner*—Kenneth W. Noland
*Attorney, Agent, or Firm*—Watson, Cole, Grindle & Watson

[57] ABSTRACT

In a method and an apparatus for putting down or taking up a load from or upon a loading location by way of a crane, wherein the crane or the loading location is subjected to substantially irregular vertical movements which change the distance between the hoisting hook of the crane and the loading location, there is accomplished a preferably continuous measuring of values which give information about the distance and relative velocity between a point on the crane and the loading location. The measuring signals are treated and possibly converted so as to create regulating signals which influence the velocity of the hoisting hook and/or the position of the crane to impart to the hoisting hook an acceleration or retardation as a compensation for the said irregular movements, so that the relative movement between the load and the loading place will follow the course desired by the operator, without undesired powerful collisions between the load and the loading location.

9 Claims, 8 Drawing Figures

METHOD FOR SETTING DOWN OR TAKING UP A LOAD FROM OR UPON A LOADING LOCATION BY MEANS OF A CRANE AND AN APPARATUS FOR CARRYING OUT THE METHOD

BACKGROUND OF THE INVENTION

The present invention relates to a method for setting down or taking up a load from or upon a loading location by means of a crane, wherein the crane or the loading location is subjected to substantially irregular vertical movements which change the distance between the hoisting hook of the crane and the loading location.

The invention also relates to an apparatus for carrying out the method.

For vessels which are on the sea or in the air, it may often in stormy weather be difficult to carry out loading and unloading operations without damaging the load. Semi-submerged drilling platforms or other seagoing vessels of the ship type which are used in work in open sea obtain, for example, a vertical movement due to waves or rolling sea. Such a movement may entail that a load which is to be put down outside the vessel by a crane thereon, or a load which is to be put down on a vessel from another seagoing vessel or, for example a helicopter, meets the base with such a force that damage is effected on the load and the base. In connection with large and heavy loads such movement may be very critical, which entails that the loading and unloading work can be carried out only during relatively calm weather conditions. This may mean a prolonged waiting time for carrying out the planned work, which in turn may raise the cost of the subject project in dislocating the progress schedule thereof.

In connection with semi-submerged drilling platforms there is known a heave compensation technique which is used during drilling operations. Here, the pressure exerted by the tip of the drill bit against the bottom of the drilling well is sensed. The pressure, which substantially is made up of the weight of the drilling string, is kept at a suitable level by controllable counteracting means. These respond in pace with the pressure changes which are due either to the increased length of the drilling string or the heaving motions of the drilling platform. In connection with heave compensation for hoisting crances, the pressure changes sensed are believed to be too small for affording a rapid and sufficiently accurate result which meets the requirements for a sterling heave compensation which are demanded for hoisting cranes on vessels at sea.

Another so-called heave compensating system is known in connection with cranes used on vessels working in open sea. The system here comprises a heave-energy absorbing device which is suspended in the hoisting hook and constitutes an extension thereof. When the load is hooked onto the hoisting hook via the energy absorbing device, which is designed with a telescope part consisting of a series of cylinders, the device will follow the wave motions or the heave motions approximately 3 to 4 times whereafter, at the top of such a motion, it will raise the load by means of the stored energy. The load will then be raised so high that it clears the top of the next wave.

Such a device is, however, only advantageous when a load is to be lifted, for example from an auxiliary vessel to a drilling platform. In landing a load on a base which moves relative to the crane, the system is without value.

SUMMARY OF THE INVENTION

Thus, the object of the present invention is to arrive at a system which in a simple and reliable manner compensates for the heave motions of the crane or the loading location, both when the load is put down and when it is taken up.

According to the invention this object is obtained by a method of the kind referred to above, characterized by accomplishing a preferably continuous measuring of units which give information about distance and relative velocity between a point on the crane and the loading location and treating and possibly converting the measuring signals to create regulating signals which influence the velocity of the hoisting hook and/or the position of the crane so as to impart to the hoisting hook an acceleration or retardation as a compensation for the said irregular movements, so that the relative movement between the load and the loading location will follow the course desired by the operator without undesired powerful collisions between the load and the loading location.

Electromagnetic waves, preferably microwaves, may conveniently be used for measuring distance and relative velocity. If desired, laser technique may be used. Another possibility consists in using a metering cord which is stretched between a point on the crane and the loading location, and which is kept taut between the fixing point and the loading location by suitable taking in and paying out means.

Aside from compensating for the irregular movements in the regulation of the hoisting machinery and/or the machinery for the crane beam directly, a device which affects the depending cable length of the hoisting hook independently of the hoisting machinery of the hoisting hook may suitably be used. Such a device may, for example, consist of reciprocatable cylinders which during normal conditions are maintained in an intermediate position and which when irregular movements of the crane or the loading location occur have imparted to them a change of position corresponding to that change of length of the hoisting cable which is necessary for compensating the said additional movements. Possibly, the device may consist of adjustable weight means which are connected to separate or common drive means for hoisting and lowering the weight means.

An apparatus for carrying out the method is, according to the invention, characterized in that it comprises means for preferably continuously measuring units which give information about distance and relative velocity between a point on the crane and the loading location and means for treating and possibly converting the measuring signals so that these may create regulating signals which influence the velocity of the hoisting hook and/or the position of the crane so as to impart to the hoisting hook an acceleration or retardation for compensating the said irregular movements, so that the relative movement between the load and the loading location will follow the course desired by the operator without unwanted powerful collisions between the load and the loading location.

BRIEF DESCRIPTION OF THE DRAWINGS

The invention will in the following be described in further details, reference being had to the drawings.

DETAILED DESCRIPTION OF PREFERRED EMBODIMENTS

Figure 1:
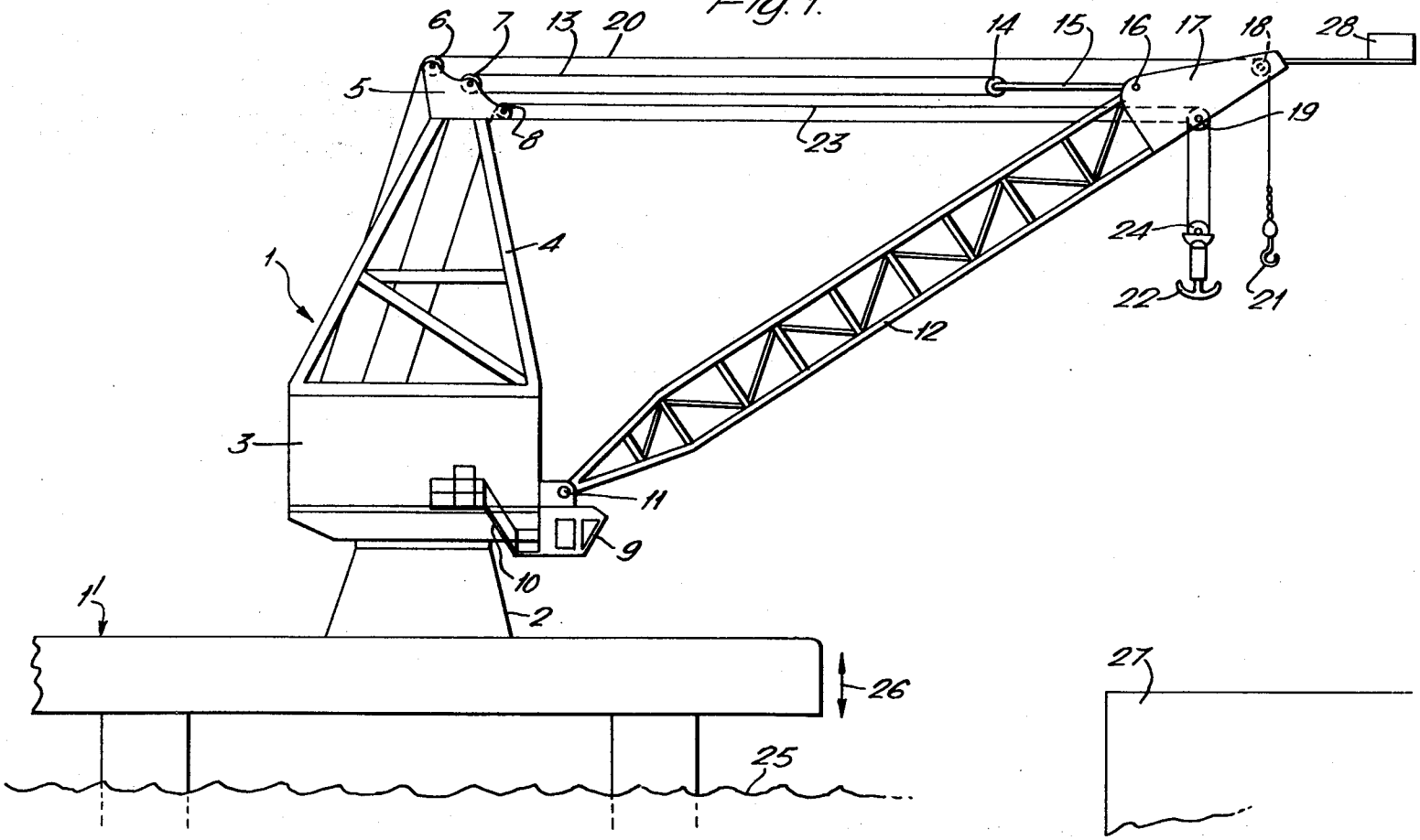
FIG. 1 is a diagrammatic view of a relatively large hoisting crane which may be mounted on a semi-submerged drilling platform or a similar vessel.

In FIG. 1, 1 is the general designation of a hoisting crane which may be on a seaborne vessel, for example a semi-submerged drilling platform as indicated at 1'. The hoisting crane 1, which is located on one of the decks of the drilling platform, mainly comprises a base 2 on which the crane may turn by means of suitable driving means (not shown). These together with driving means for the remaining movements to be performed by the crane, are accommodated in a machine housing 3, the upper part of which merges with an upwardly extending framework 4. The latter is provided with a top part 5 in which three blocks 6, 7 and 8 are supported. Below the machine housing 3 a driver's cab is provided and a ladder 10 extends between this and the machine housing 3. Above the driver's cab 9 there is located a bearing point 11 for one end of the crane beam 12 which is kept in a protruding position by means of a cable 13 extending from a driving drum (not shown) in the machine housing 3 via the block 7 and via a second block 14 to an attachment point on the top part 5. The block 14 is rotatably supported in one end of a tension rod 15, the other end of which is pivotally attached close to the top of the crane beam as indicated at 16 in FIG. 1. In the free outer end 17 of the crane beam, two blocks 18 and 19 are rotatably mounted, the block 18 serving to guide a cable 20 for a first hoisting hook 21 and the block 19 serving to guide a cable 23 for a second, larger hoisting hook 22.

As appears from FIG. 1, the hoisting cable 20 extends from the area of the hoisting hook 21 via the blocks 18 and 6 back to the machine housing in which, for example, it is wound up on a driving drum (not shown). The hoisting cable 23 is firmly anchored at the block 8 and extends therefrom around a block 24 on the hook 22 and via the block 8 back to the machine housing in which, in the same manner as the cable mentioned above, it is wound up on a driving drum.

As mentioned, the hoisting crane 1 may be mounted on, e.g., a semi-submerged drilling platform 1', the upper part thereof projecting above the water level 25. Such a semi-submerged vessel is subjected to motions due to heavy sea, which entails that the vessel heaves up and down. Such a heaving motion is indicated by a double arrow 26. If a load is to be put down, for example by means of the hoisting hook 22, the hoisting hook will, in addition to the movement desired by the crane operator, have superimposed thereonto a vertical additional movement caused by the heave and/or rolling movements of the vessel 1'. If the hook 22 is to lower a relatively large load towards a base 27, the load may, as a consequence of the heaving motions, meet the base with such a force that the load and/or the base are heavily damaged.

For balancing the heave motions to which the carrying vessel is subjected and which are transferred to the load as an undesired and critical additional motion, a device 21 is provided at the top of the hoisting beam 12, which device substantially continuously accomplishes measurements of values affording information about distance and relative velocity to the location on the base 27 at which the load is to be taken up or put down. Conveniently, the device 21 may comprise one or more transmitters for transmitting electromagnetic waves, preferably microwaves, or one or more receivers for receiving the waves transmitted and reflected from the loading location 27. In association with the means 28 or on some other suitable location, for example in the driver's cab 9, there may be provided means for treating and possibly converting the measuring signals and for transferring them to suitable regulating means serving to influence the velocity of the hoisting hook and/or the position of the crane beam. Thereby it is achieved that the relative movement between the hoisting hook 22 or the load itself and the loading locations becomes independent of the additional motions caused by the movement of the vessel. The hoisting hook 22 can then follow the course of motion desired by the crane operator, which gives the load a soft landing on the loading location 27. This is accomplished due to the fact that as a compensation to the additional motions which are due to the heave motions of the carrying vessel, the load will have imparted to it an acceleration or retardation which counteracts the motion of the vessel and hence prevents undesired powerful collisions between the load and the loading location 27.

Figure 2:
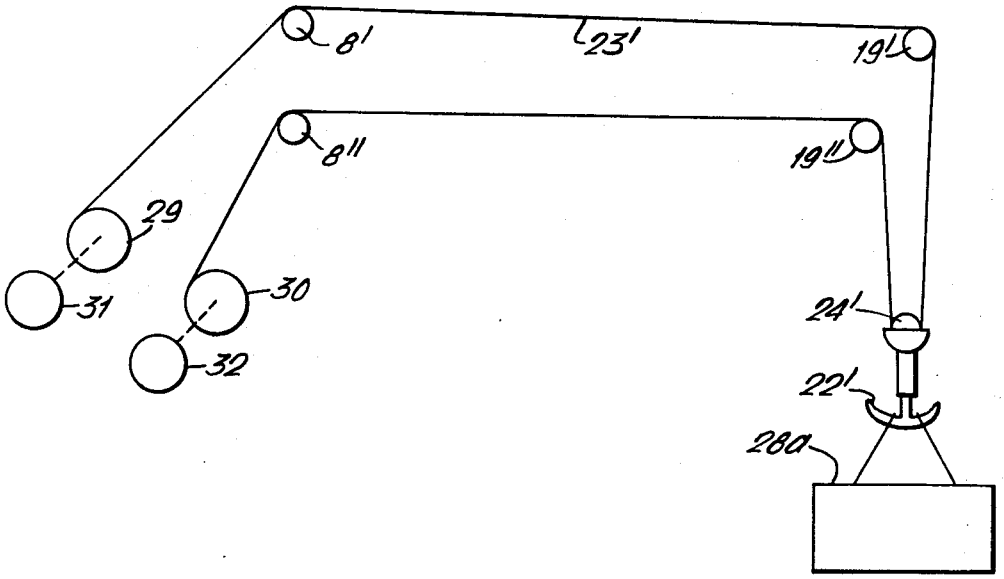
FIG. 2 is a diagrammatic sketch illustrating the principle of the hoisting winch of the crane.

In FIG. 2, which is a diagrammatic sketch illustrating the principle of one of the hoisting winches of the crane, e.g., of the hoisting hook 22, 22' designates the hoisting hook itself which carries a load 28*a*. 8', 8'', 19', 19'' and 24' denote blocks over which the hoisting cable 23' is passed, one end of the cable 23' being wound onto a first hoisting drum 29, whereas the other end is wound onto a second hoisting drum 30. The hoisting drums 29 and 30 are arranged for rotation in different directions and can via transmissions (not shown) be connected to separate motors as indicated at 31 and 32 respectively. It is to be understood that, if desired, the hoisting drums 29 and 30 may be connected to a common drive motor.

Figure 3:
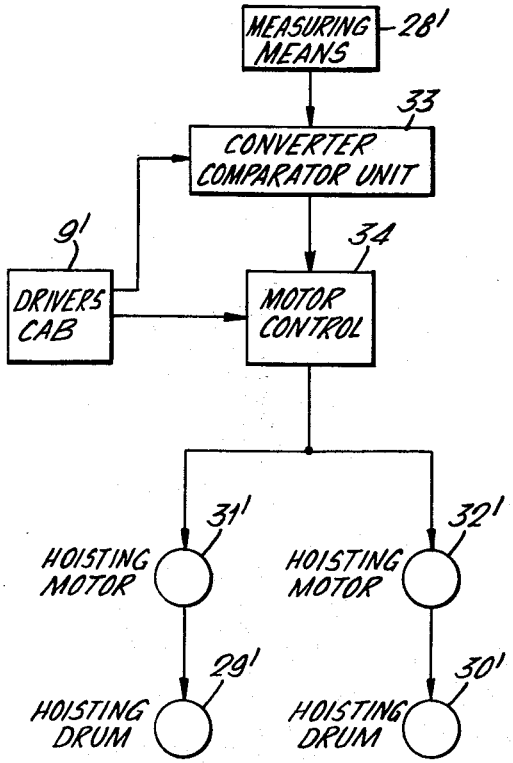
FIG. 3 is a simplified block diagram of a first embodiment of a regulating course comprising the method according to the present invention.

In FIG. 3, there is shown a simplified block-diagram of a first embodiment of a regulating course serving to compensate for the heave motions or the additional motions to which the crane is subjected and which disturb the normal acceleration or retardation course for the load when this is to be lifted from or put down on the loading location. In FIG. 3 the block 28' designates a means corresponding to the means 28 discussed in connection with FIG. 1 and which measures values giving information about distance and relative velocity between the top point of the crane beam 12 and the loading location 27 (FIG. 1). The measuring signals from the measuring means 28' are supplied to a block 33 which is a converter/comparator unit. The latter also receives information signals from the driver's cab which here is indicated by the block 9'. The control signals from the driver's cab 9' are supplied to the block 34 which represents motor control and which also receives the signals transmitted from the block 33. From the motor control 34 signals are supplied to a motor 31' driving the hoisting drum 29', and to a motor 32' driving the hoisting drum 30', respectively.

If there is a fixed distance between the measuring means 28 and the loading location 27 (FIG. 1), the motor control 34 will be influenced only by the control signals arriving from the driver's cab 9'. The hoisting and lowering of the hook 22' with its load 28A is then accomplished according to the course decided by the crane driver, whether this is produced by manual control, semiautomatically or fully automatically, this course involving that the load is given a retardation or acceleration which prevents undesired powerful collisions between the load and the loading location when the load is to be put down or taken up.

If the measuring instrument 28' detects a change of distance between the top of the crane beam and the loading location, i.e., a relative motion therebetween, a signal is transmitted from the measuring instrument 28' to the converter/comparator unit 33. The latter may be so adapted that based on the information signals received from the operator's cab giving information about the velocity of the hoisting hook and of its position relative to the loading location it can decide whether a regulating signal is to be transmitted to the motor control 34. The condition for the transmission of regulating signals can be, for example, that during lowering the load is so close to the loading location that compensation regulation is required, superfluous compensation then being avoided in connection with large hoisting lengths during the phase of the hoisting when the load is high above the base.

If the conditions for compensation is fulfilled, the unit 33 will transmit regulating signals to the motor control 34, which make the hoisting hook follow the predetermined course of motion, so that the hook with its load approaches the loading location with an optimum, uniform velocity.

In other words, the block diagram according to FIG. 3 illustrates an embodiment of a regulating system for heave compensation for crane motions, wherein the measuring signals are supplied directly to the control means of the hoisting machinery for influencing the motions of the hoisting hook, possibly in connection with given preset conditions.

Figure 4:
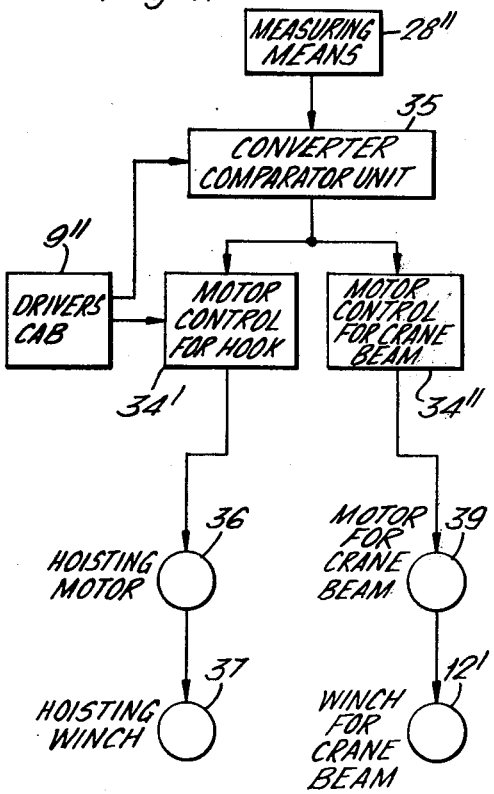
FIG. 4 is a simplified block diagram of a second embodiment of a regulating course comprising the method according to the invention.

In FIG. 4 there is shown a simplified block diagram of a second embodiment of a regulating course for heave compensation of the motion of the hoisting hook. Aside from supplying compensation signals to the motor control of the hoisting machinery, the compensation signals will in this case also be supplied to the machinery of the crane beam for influencing the motion thereof. In FIG. 4, 28" designates a measuring instrument or means as described in connection with the means 28 in FIG. 1, and this instrument is connected to a converter/comparator unit 35. The unit 35 receives information signals from the driver's cab 9" in a similar manner as the unit 34, according to FIG. 3, and both from the driver's cab 9" and the unit 35, control signals are supplied to a first motor control 34' for the hoisting hook 22' as well as to a second motor control for the crane beam 12 (FIG. 1). Control signals from the motor control 34' are supplied to a hoisting motor 36 driving the hoisting winch 37 for the hoisting hook, whereas control signals from the motor control 34" are transferred to a motor 39 for moving the winch 12' of the crane beam.

A regulating course of the type illustrated in FIG. 4, wherein both the hoisting machinery and the machinery for the movement of the hoisting btam are influenced for the purpose of compensating for the heave motions of the carrying ship, may find practical application in cranes of moderate weight and dimensions, if desired in those positions of the crane beam in which the stresses of the machinery causing the movement of the crane beam are at a minimum. In the case of large crane dimensions, i.e., large crane beams and heavy loads, it may be appropriate to use the regulating course sketched and discussed in connection with FIG. 3.

Figure 5:
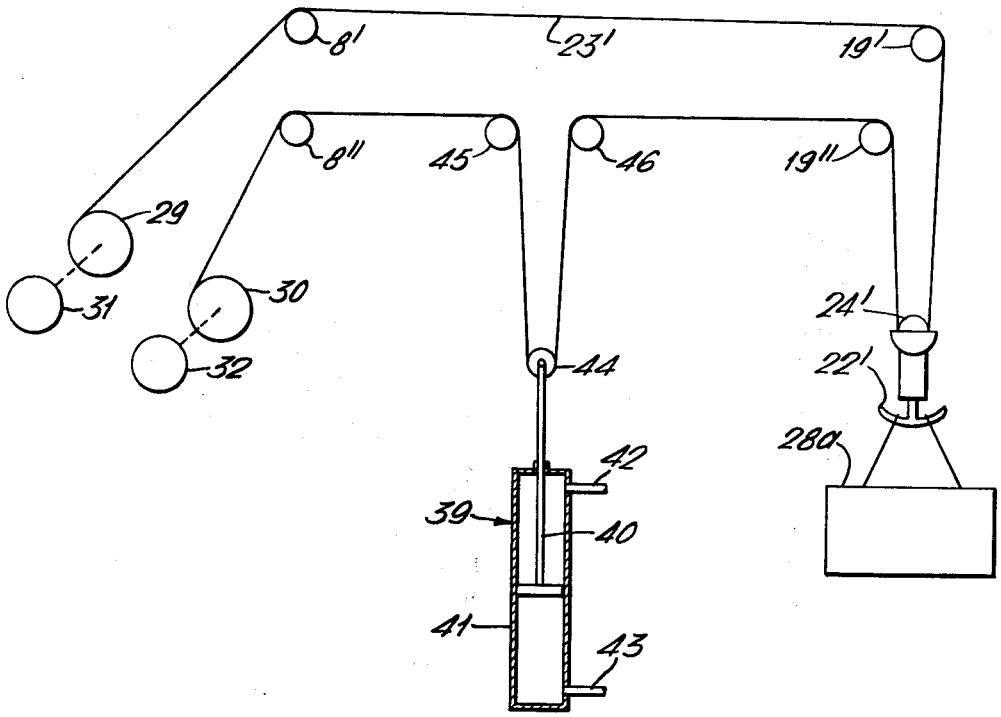
FIG. 5 is a diagrammatic sketch illustrating the principle of the hoisting winch of the crane, including a first device according to the invention for automatic compensation regulation of the hoisting cable.

In FIG. 5 there is diagrammatically illustrated a special way in which the depending length of the hoisting cable may be regulated. The diagrammatic sketch illustrating the principle of the hoisting winch of the crane is here approximately similar to the sketch shown in FIG. 3 and identical reference numerals are therefore used for corresponding parts. What distinguishes the sketch in FIG. 5 from the sketch of FIG. 3 is that between the blocks 8" and 19" a hydraulic means is interposed which is generally designated by 39 and which mainly comprises a hydraulic cylinder 41 having a reciprocatable piston 40. To the cylinder 41 there are connected pressure conduits 42 and 43 connected to hydraulic aggregates (not shown) as well as control means and valve means (not shown) for regulating the position of thee piston. The protruding end of the piston arm carries a block 44 around which the hoisting cable 23' is passed via additional blocks 45 and 46. Under normal conditions the piston rod 40 is kept in an intermediate position. When the load 28*a* depending from the hook 22' moves in a manner which deviates from the desired course of movement, a change of position is imparted to the piston rod 40 for shortening or lengthening the hoisting cable and thereby compensating for the undesired additional movement of the crane.

Figure 6:
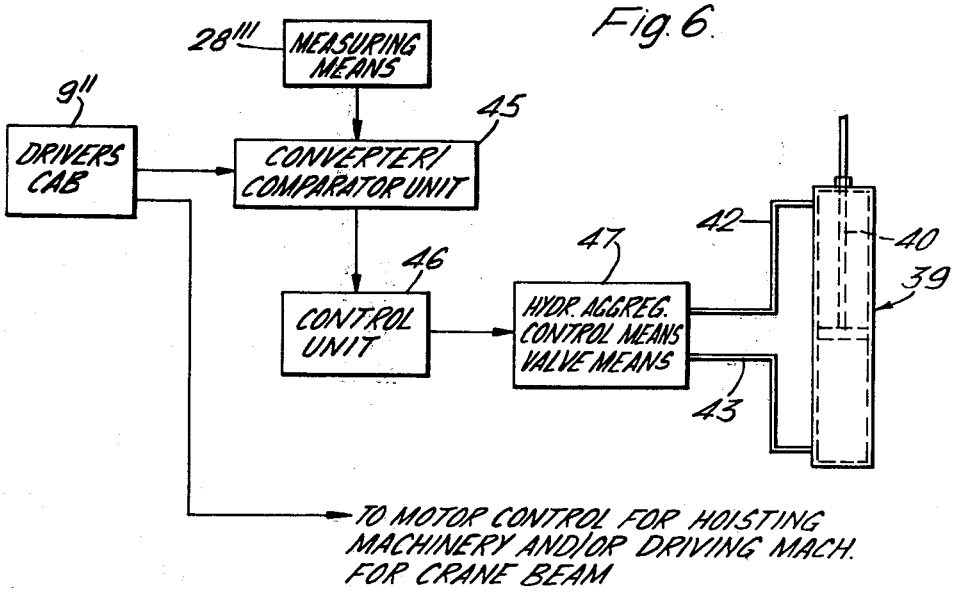
FIG. 6 is a simplified block diagram of the control course associated with the device of FIG. 5.

In FIG. 6 there is by means of a simplified block-diagram sketched a control course which may be used in connection with the embodiment illustrated in FIG. 5. As appears from both FIGS. 5 and 6 the additional motion is here compensated for independently of the control of the hoisting machinery. As illustrated in FIG. 6, the control signals from the driver's cab 9" are supplied directly to the motor control for the hoisting machinery and/or the driving machinery of the crane beam, whereas information signals of the type discussed previously are transmitted to a converter/comparator unit 45. The unit 45 also receives signals from the measuring means 28'''. From the unit 45 signals are transferred to a control unit 46 which in turn influences the means 47 which comprises the hydraulic aggregates with control means and valve means discussed in connection with FIG. 5, and which imparts to the piston rod 40 an appropriate movement in one or the other direction depending on the deviation of the load from the desired course of movement consequent to the heave motions of the vessel.

Figure 7:
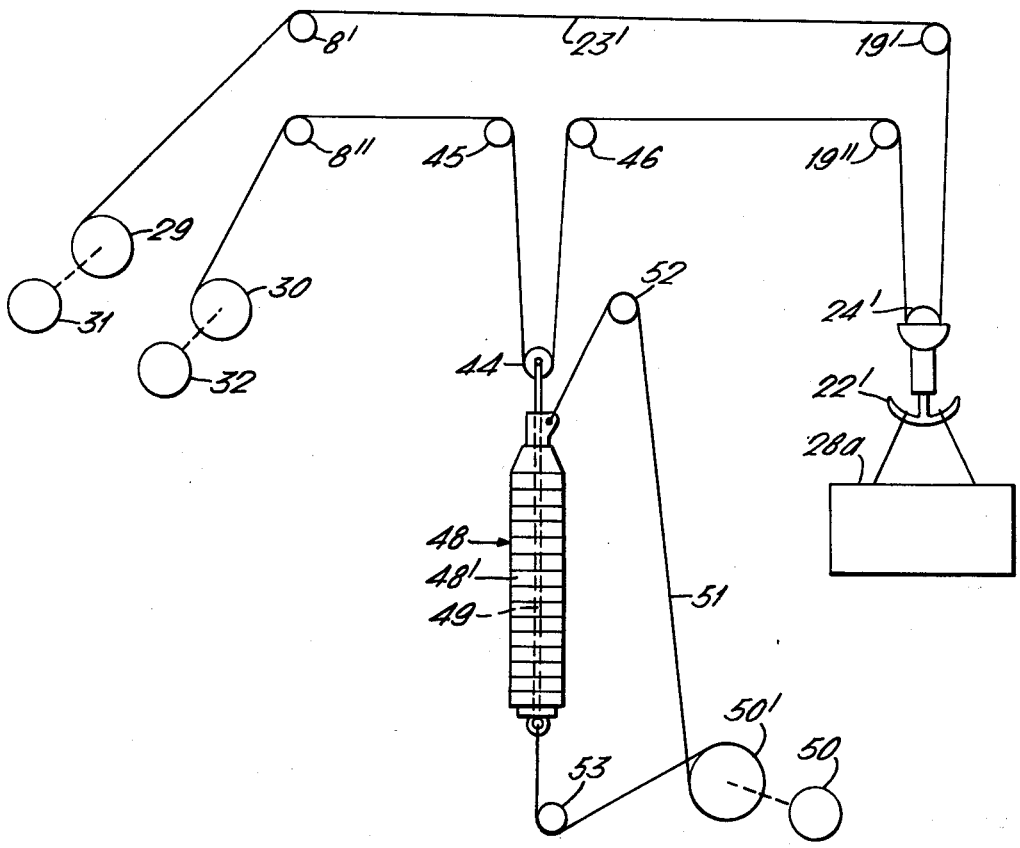
FIG. 7 is a diagrammatic sketch illustrating the principle of the hoisting winch of the crane, including a second device according to the invention for automatic compensation regulation of the hoisting cable.

In FIG. 7 there is illustrated another embodiment of a device which influences the depending cable length of the loading hook independently of the hoisting machinery of the hoisting hook. The device here consists of one or more adjustable weights depending from the block 44 and generally designated 48. The gravity of each weight or the number of weights may be adapted to the gravity of the load. The weight may conveniently consist of disk-shaped concrete elements 48' provided with a central opening and threaded onto a rod 49. Through a cable 51 which passes an upper block 52 and a lower block 53, and which with its two ends is attached to the top and the bottom of the weights, respectively, each weight 48 is connected to a separate drum 50' driven by a separate or a common driving means 50 for hoisting and lowering the weights whenever compensation for the heave motion of the vessel is required.

Figure 8:
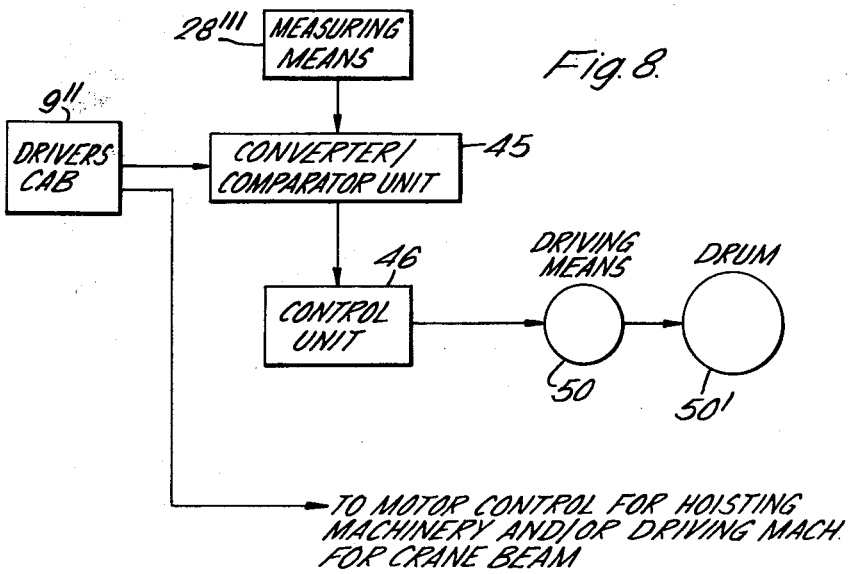
FIG. 8 is a simplified block diagram of the control course associated with the device of FIG. 7.

A simplified block diagram of a control course that may be used in connection with the embodiment illustrated in FIG. 7 is disclosed in FIG. 8 which approximately corresponds to the block diagram of FIG. 6 with the exception that the hydraulic control 47 and the hydraulic device 39 are here substituted by the drive means 50 driving the drum 50' for the cable 51.

It is to be understood that the present invention may be carried out in other ways than those described above, without departing from the scope of the invention. For measuring the values expressing distance and relative velocity between a point on the crane and the loading location, it is possible, for example, in addition to the microwaves to a laser technique. If desired, there may be used a metering cord which is extended between a point on the crane beam and the loading location, and which is maintained taut between the attachment point on the crane and the loading location by suitable taking in and paying out means. In connection with the metering cord, there may suitably be used a counting device which in suitable length units registers the length of the cord and hence the desired distance, the counting device being connected to suitable means sensing the change of length of the cord per unit of time.

For the measuring it is also possible to use instruments using ultra-sound or optics. Further, accelerometers may be used which measure to heave dynamic motions of the crane beam, or instruments measuring the heave angle position of the crane beam relative to a given reference position.

The regulating means discussed which influence the various drive means must, of course, be of such a type that they maintain optimum hoisting and lowering conditions. In other words, it is necessary to elect and adapt regulators of the types proportional regulator, proportional/integral regulator, proportional/derivate/integral regulator, etc., depending on the conditions prevailing at the place of operation.

What I claim is:

1. In a method for putting down or taking up a load from or upon a loading location by means of a crane, wherein the crane or the loading location is subjected to substantially irregular vertical movements which change the distance between the hoisting hook of the crane and the loading location, and wherein there is accomplished a preferably continuous measuring of units which give information about distance and relative velocity between a point on the crane and the loading location and treating and possibly converting the measuring signals so as to create regulating signals which impart to the hoisting hook an acceleration or retardation as a compensation for the irregular movements, so that the relative movement between the load and the loading location will follow the course desired by the operator, without undesired powerful collisions between the load and the loading location, and wherein the measuring signals are supplied to a device which affects the depending cable length of the hoisting cable independently of the hoisting machinery thereof, the improvement comprising the steps of providing at least one adjustable gravity influenced weight means for regulating the depending length of the hoisting cable, connecting said weight means, maintaining said weight means during normal conditions in an intermediate position and thereafter moving said weight means out of said intermediate position to shorten or lengthen the hoisting cable.

2. The method according to claim 1, characterized by using concrete elements as said weight means.

3. The method according to claim 1, characterized by using electromagnetic waves, preferably microwaves, for the measuring.

4. The method according to claim 1, characterized by using a laser technique, optics or ultra-sound for the measuring, possibly in combination.

5. In an apparatus for carrying out a method for setting down or taking up a load from or upon a loading location by means of a crane, wherein the crane or the loading location is subjected to substantially irregular vertical movements which change the distance between the hoisting hook of the crane and the loading place, comprising means for preferably continuously measuring values which give information about distance and relative velocity between a point on the crane and the loading location, means for treating and possibly converting the measuring signals so as to create regulating signals which influence the velocity of the hoisting hook and/or the position of the crane, and a device provided in the cable path of the loading hook, which device in response to signals from the measuring means or converting means influences the depending cable length of the loading hook independently of the hoisting machinery thereof, the improvement wherein the device for regulating the depending cable length of the hoisting hook comprises at least one adjustable gravity influenced weight means connected to drive means for hoisting and lowering the weight means in response to undesired additional motions of the hoisting hook.

6. The apparatus according to claim 5, characterized in that the weight means include concrete balancing elements.

7. The apparatus according to claim 5, characterized in that the measuring means comprise at least one transmitter and at least one receiver operating with a laser technique, optics or ultra-sound, possibly in combination.

8. The apparatus according to claim 5, characterized in that the measuring means comprise accelerometers which measure the heave dynamic motions of the crane beam.

9. The apparatus according to claim 5, characterized in that the measuring means comprise instruments for measuring the angular alteration of the crane beam relative to a given reference position.

* * * * *